US010878987B2

(12) United States Patent
Omolayo

(10) Patent No.: US 10,878,987 B2
(45) Date of Patent: Dec. 29, 2020

(54) GAPPED RESONANT CURRENT TRANSFORMER

(71) Applicant: Standex International Corporation, Salem, NH (US)

(72) Inventor: Kehinde Omolayo, Cincinnati, OH (US)

(73) Assignee: Standex International Corporation, Salem, NH (US)

( * ) Notice: Subject to any disclaimer, the term of this patent is extended or adjusted under 35 U.S.C. 154(b) by 159 days.

(21) Appl. No.: 15/977,247

(22) Filed: May 11, 2018

(65) Prior Publication Data

US 2018/0330865 A1 Nov. 15, 2018

Related U.S. Application Data

(60) Provisional application No. 62/504,627, filed on May 11, 2017.

(51) Int. Cl.

| | |
|---|---|
| ***H01F 17/06*** | (2006.01) |
| ***H01F 27/24*** | (2006.01) |
| ***H01F 27/40*** | (2006.01) |
| ***H01F 27/29*** | (2006.01) |
| ***H01F 38/30*** | (2006.01) |
| ***H01F 3/14*** | (2006.01) |
| ***H01F 38/32*** | (2006.01) |

(52) U.S. Cl.

CPC ..... *H01F 27/24* (2013.01); *H01F 3/14* (2013.01); *H01F 27/29* (2013.01); *H01F 27/40* (2013.01); *H01F 38/30* (2013.01); *H01F 38/32* (2013.01)

(58) Field of Classification Search

CPC ..... H01F 3/14; H01F 17/06; H01F 17/062; H01F 27/24; H01F 27/40; H01F 27/29; H01F 21/12; H01F 38/32; H01F 38/30; H01F 38/28; H01F 38/34; H01F 2038/305

USPC ..... 336/178, 229, 212, 173, 150, 210

See application file for complete search history.

(56) References Cited

U.S. PATENT DOCUMENTS

| | | | | | |
|---|---|---|---|---|---|
| 1,706,139 | A * | 3/1929 | Boyajian | H01F 38/28 | 323/334 |
| 3,546,565 | A * | 12/1970 | Koll | H01F 38/28 | 323/309 |
| 5,075,628 | A * | 12/1991 | Schuster | G01R 31/52 | 324/510 |
| 5,617,019 | A * | 4/1997 | Etter | G01R 15/186 | 324/117 R |
| 6,492,893 | B2 * | 12/2002 | De Graaf | H01F 3/14 | 29/602.1 |
| 9,753,469 | B2 * | 9/2017 | McCollough | G05F 1/335 | |
| 2003/0222747 | A1 * | 12/2003 | Perkinson | H01F 38/30 | 336/178 |
| 2009/0115403 | A1 * | 5/2009 | Bernklau | G01R 15/186 | 324/127 |
| 2013/0200971 | A1 * | 8/2013 | Crutcher | H01F 27/24 | 336/90 |

(Continued)

*Primary Examiner* — Mang Tin Bik Lian

(74) *Attorney, Agent, or Firm* — Saxton & Stump, LLC

(57) ABSTRACT

A gapped resonant current transformer that has a predetermined gap in a split-core. The invention eliminates the need for a magnetic flux shunt between the primary and secondary windings. Further, the sensitivity to the clamping force holding the two halves of the split-core is reduced as well as temperature effects on the core. Finally, excess heat is removed from overload (saturation) by circulating power back into the line.

7 Claims, 2 Drawing Sheets

(56) References Cited

U.S. PATENT DOCUMENTS

| | | | | |
|---|---|---|---|---|
| 2014/0160820 | A1* | 6/2014 | McKinley | H01F 29/025 363/126 |
| 2015/0206645 | A1* | 7/2015 | Cook | H01F 27/02 336/216 |
| 2015/0310984 | A1* | 10/2015 | Qin | H01F 1/15333 336/178 |

* cited by examiner

GAPPED RESONANT CURRENT TRANSFORMER

This application claims benefit of U.S. Provisional Application Ser. No. 62/504,627 filed on May 11, 2017, pursuant to 35 USC § 119(e).

FIELD OF THE INVENTION

This invention relates to current transformers, in particular, gapped resonant current transformers for power supply directly from a utility line grid.

BACKGROUND OF THE INVENTION

The ferroresonant transformer or constant voltage transformer (ferro or CVT) has a very long history having been invented in 1938 by Joseph Sola and continuing to sell tens of thousands of units per year. The ferro of today has had some minor improvements but remains fundamentally unchanged from the original design.

Well known for its longevity, some CVTs are found still in service after more than 40 years. Limited to single phase applications, the ferro is slowly being displaced by small electronic voltage regulators.

The CVT uses the unique principle of ferroresonance: operation of a transformer in the region of magnetic saturation. When the core of a transformer is in saturation, relatively large changes in winding current results in very small changes in magnetic flux or induced voltage.

Current transformers are often used to monitor line currents for measurement purposes or to supply a small amount of power to external circuits for other electronic purposes. This external circuit or load, may contain a microprocessor or other electronic components. The output voltage from this transformer will be proportional to the input current. However, such external circuits can be damaged if the line current supplying the power is too high.

Previous devices have placed a separate circuit between the transformer output and the load to limit the amount of voltage passed on to the critical load circuit. This limiting circuit adds cost and can reduce the efficiency of the device, consuming the rather limited amount of power usually available from the current transformer. Addition of a gap in the core will allow control of the magnetic flux harmonic in the core and, thus, limit the transformer noise level. However, this reduces the coil inductance and magnetic coupling factor of the current transformer.

Other prior designs use a ferroresonant transformer for voltage regulation. A ferroresonant transformer has a magnetic shunt that separates the primary and secondary (load and capacitor) magnetic flux during saturation; whereas, the construction of this invention is relatively simple. It's a toroid core having a load winding and a second winding with a capacitor. The invention does not require the magnetic flux shunt between the primary and secondary windings.

SUMMARY OF THE INVENTION

It is an aspect of the invention to provide a resonant current transformer having a gapped split-core that reduces the sensitivity of the installation clamping force on the split core on the power output.

Another aspect of the invention is to provide a resonant current transformer having a gapped split-core that reduces the sensitivity of the interface between the two halves of the core relative to the finish and flatness of the mating surfaces which is hard to maintain during the manufacture and control during field installation.

It is an aspect of the invention to provide a resonant current transformer having a gapped split-core that substantially reduces the effect of temperature on the core saturation point.

It is an aspect of the invention to provide a resonant current transformer having a gapped split-core that reduces the sensitivity of the power output to environmental corrosion conditions.

Another aspect of the invention is to provide a resonant current transformer having a gapped split core that removes excess heat from overload (saturation) conditions by circulating power back into the line.

Finally, it is still another aspect of the invention to provide a resonant current transformer having a gapped split-core that eliminates the need for a solid-state crowbar circuit thereby substantively reducing additional cost and electrical or audible noise in the system due to device switching characteristics.

DETAILED DESCRIPTION OF THE INVENTION

Figure 1:
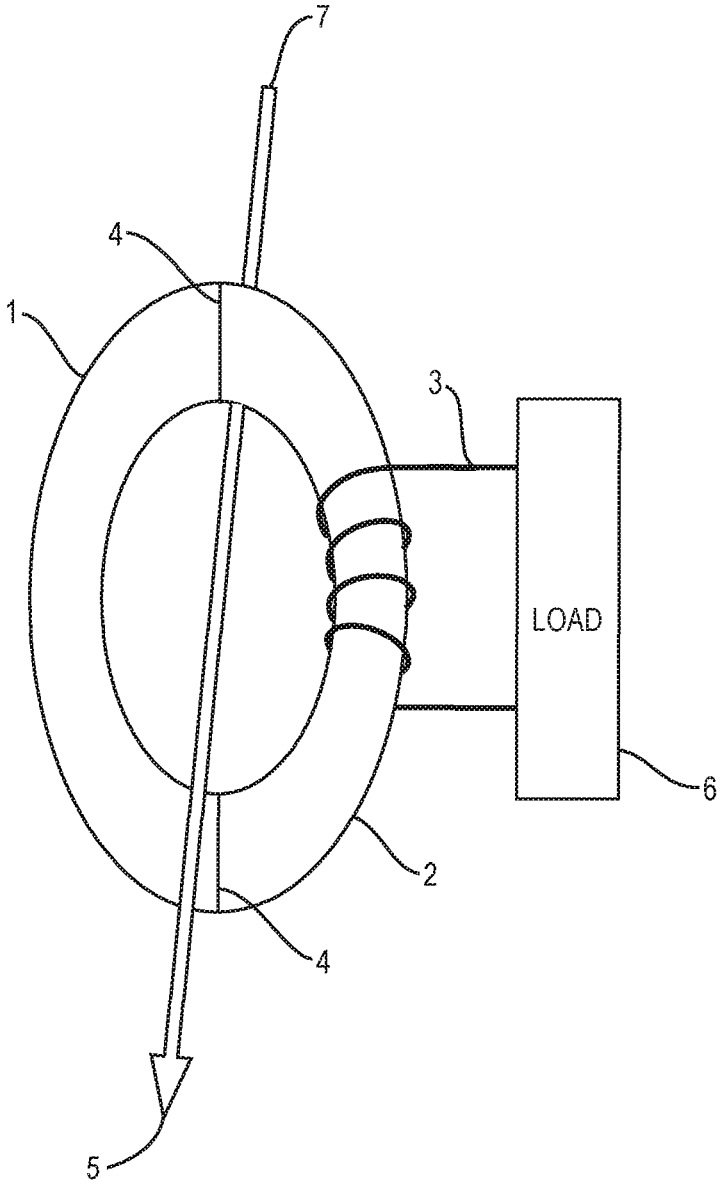
FIG. 1 (PRIOR ART)
FIG. 1 is an illustration of the prior art.

Now referring to FIG. 1, this is an illustration of the prior art having a current transformer with a winding used to supply a small amount of power to a load. Toroid core 1 is cut into two halves 1 & 2 forming interfaces 4's. Bus wire 7 conducting line current 5 causes a magnetic flux to be generated in the core. Load winding 3 coupled to this magnetic flux provides voltage to output load 6.

Figure 2:
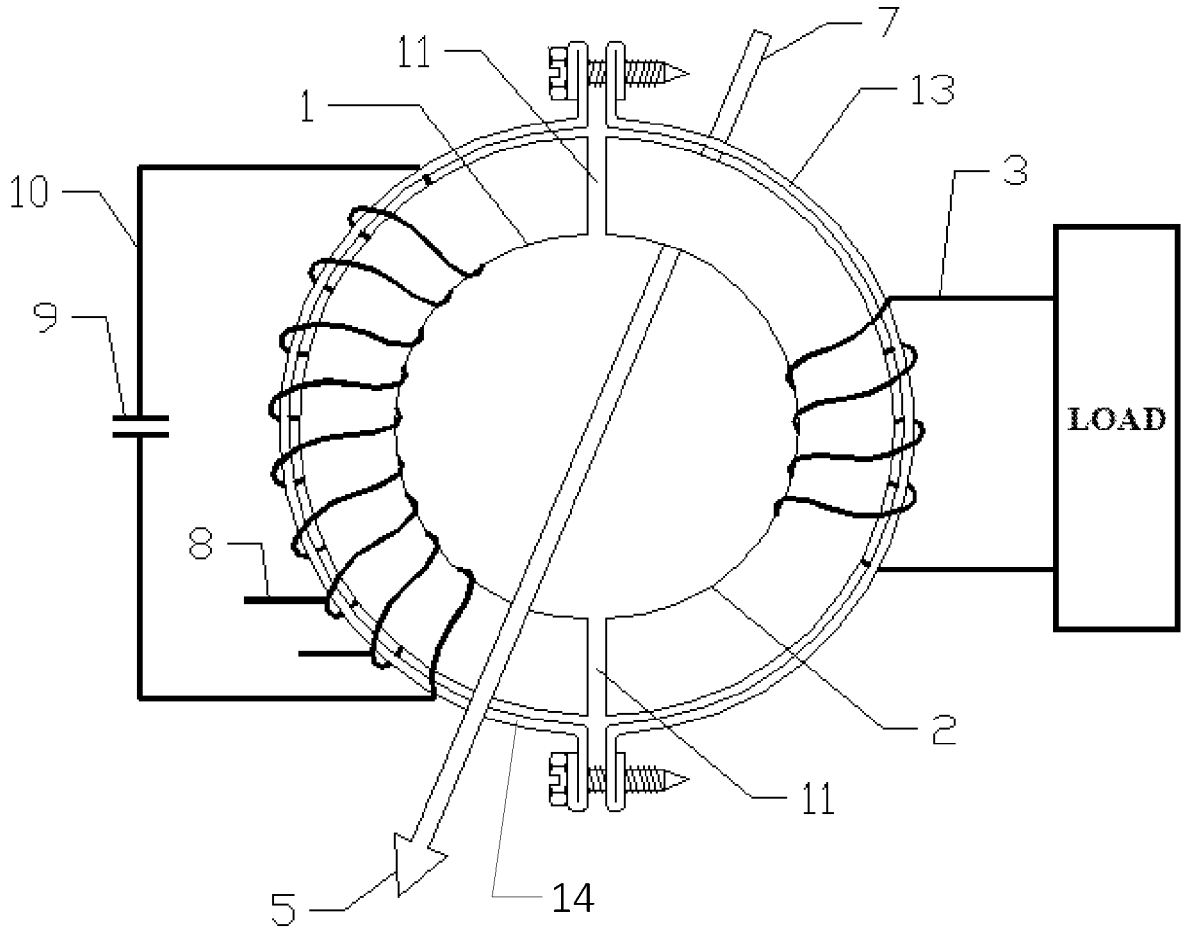
FIG. 2 is an illustration of resonant current transformer having a gapped split-core in accordance with the invention.

As shown in FIG. 2, there is an illustration of the present invention. This invention uses toroid core 1 cut in two halves where a nonmagnetic material 11 (such as parylene, paint, tape, etc.) of known thickness is placed in the two gaps to protect the core interfaces from environmental corrosion. The two halves are held in position by a clamp 13, 14. Bus wire 7 conducting line current 5 causing a magnetic flux to be generated in the core. Winding 3 coupled to this magnetic flux provides voltage to load 6. Added to this core and coupled to the magnetic flux is an auxiliary winding 10 of higher turn count. This winding is connected to a capacitor 9 to form a circuit resonate at the line frequency. FIG. 2 also shows taps 8 which allow selection during manufacturing of the best match between the line frequency and the circuit self-resonant frequency. This optimum match improves the maximum output power over the prior art.

High voltage spikes may be destructive to the output load with a prior art device. Voltage slow rate of change across the invention capacitor 9 of FIG. 2 suppresses the voltage spikes or peeks.

Although the present invention has been described with reference to certain preferred embodiments thereof, other versions are readily apparent to those of ordinary skill in the preferred embodiments contained herein.

What is claimed is:

1. A resonant current transformer comprising:

a toroid core cut into a first and a second substantially identical halves wherein the first and the second substantially identical-halves are clamped together to form a pre-determined gapped split-core, the pre-determined gapped split-core having an installation clamping force requirement and two pre-determined gaps, the two pre-determined gaps of the split-core being filled with a nonmagnetic material including at least one of parylene, paint, or tape;

a bus wire conducting a line current through the pre-determined gapped split-core causing a magnetic flux to be generated in the pre-determined gapped split-core;

a first winding disposed around at least a portion of the first substantially identical half of the toroid core, the first winding inducing the magnetic flux to provide a voltage to a load;

a second winding disposed around at least a portion of the second substantially identical half of the toroid core, the second winding including a capacitor to provide a resonate circuit at a line frequency of the bus wire; and at least one tap on the second winding, wherein the at least one tap is configured for optimizing a match between the line frequency and the resonate circuit to maximize output power.

2. The resonant current transformer of claim 1, wherein the nonmagnetic material placed within the two pre-determined gaps is parylene.

3. The resonant current transformer of claim 1, wherein the nonmagnetic material placed within the two pre-determined gaps is paint.

4. The resonant current transformer of claim 1, wherein the nonmagnetic material placed within the two pre-determined gaps is tape.

5. The resonant current transformer of claim 1, wherein the nonmagnetic material placed within the two pre-determined gaps protects the core interfaces from environmental corrosion.

6. The resonant current transformer of claim 1, wherein the first winding is remote from the second substantially identical half of the toroid core.

7. The resonant current transformer of claim 1, wherein the second winding is remote from the first substantially identical half of the toroid core.

* * * * *